US010753032B2

(12) United States Patent
Qiu

(10) Patent No.: US 10,753,032 B2
(45) Date of Patent: Aug. 25, 2020

(54) LAUNDRY MACHINE ADD-ON BOX FOR DETERGENT DISPENSING

(71) Applicant: Yuanlin Qiu, N Bellmore, NY (US)

(72) Inventor: Yuanlin Qiu, N Bellmore, NY (US)

( * ) Notice: Subject to any disclaimer, the term of this patent is extended or adjusted under 35 U.S.C. 154(b) by 331 days.

(21) Appl. No.: 15/994,419

(22) Filed: May 31, 2018

(65) Prior Publication Data

US 2019/0368109 A1 Dec. 5, 2019

(51) Int. Cl.

*D06F 39/02* (2006.01)
*D06F 39/08* (2006.01)
*D06F 33/00* (2020.01)

(52) U.S. Cl.

CPC ..... *D06F 39/022* (2013.01); *D06F 33/00* (2013.01); *D06F 39/085* (2013.01); *D06F 2212/00* (2013.01)

(58) Field of Classification Search

CPC ..... D06F 39/022
See application file for complete search history.

(56) References Cited

U.S. PATENT DOCUMENTS

2009/0288452 A1* 11/2009 Lee ..... D06F 39/02 68/12.18
2009/0293556 A1* 12/2009 Lee ..... D06F 39/022 68/17 R
2011/0095049 A1* 4/2011 Eichholz ..... D06F 39/022 222/23

* cited by examiner

*Primary Examiner* — Jason Y Ko
(74) *Attorney, Agent, or Firm* — Jie Tan; JT Law Services, PC

(57) ABSTRACT

A laundry machine add-on box for automatic dispensing detergent. The add-on box contains a dispensing mechanical assembly and an electric pumping assembly and controller that is connected to the electronic control panel of the laundry machine.

10 Claims, 13 Drawing Sheets

LAUNDRY MACHINE ADD-ON BOX FOR DETERGENT DISPENSING

CROSS-REFERENCE

This application claims the priority of the U.S. provisional patent application No. 62/625,463 filed on Feb. 2, 2018, the entirety of which is hereby incorporated by reference.

DESCRIPTION OF RELATED ART

The present application relates to laundry machines, in particular to an laundry washer machine add-on box that automatically aliquots certain amount of detergent for laundry washer machine from a detergent container.

Automatic laundry washing machines have been used commercially and in homes for many decades. In each case, the user has to measure and dispense a quantity of detergent into the machine at the start of a wash cycle. Users need to bring the detergent container to the laundry washer and manually perform the task of detergent dispensing. In a commercial laundry place, not all detergent dispensing are performed skillfully, users may spill detergent on the floor or on the wash machine and litter detergent containers around the store, creating a safety problem for other users and a management problem for laundromat owners. Empty detergent containers littered around the laundry room also create an aesthetic and hygiene problem for the laundromat.

Hotel guests and short term-living travelers often need to go to a commercial laundry place to do clothing washing. They generally cannot consume a whole bottle of laundry detergent. It would save them time and money if the laundry machines in the laundromat can provide laundry detergent by itself.

This has been a recognized need in the laundry washer industry, for example, U.S. Pat. No. 8,555,677 describes a washer machine having a built-in detergent dispensing apparatus, with complicated sensor and controller design, this dispensing apparatus has very little portability to be used with current laundry wash machines. US 2006/0117811 describes a simpler liquid laundry detergent dispenser using a reservoir that holds a quantity of detergent and a timer circuit that controls an air pump. By pressing certain amount of air into the reservoir, the detergent in the reservoir is dispensed into the laundry machine. Installation of this dispensing mechanism requires additional space both inside the washer machine and outside the washer machine, it requires hours of manual adjusting, installation cost is too high for many laundromat and it may be not safe to operate and maintain in a commercial laundromat.

A portable, all-in-one, easy to install and easy to manage laundry machine detergent dispensing apparatus is needed.

SUMMARY

The present application discloses a new and a simple approach for automatic laundry machine detergent dispensing.

An all-in-one detergent dispensing add-on box is provided for easy and improved installation, which performs automatic detergent dispensing upon turning on the laundry washer machine.

In one embodiment, the laundry machine add-on box comprises a set of tubing and mechanical structures for automatic dispensing detergents into a cup or a washer machine, a set of containers for storing laundry detergents, a set of pumps for pumping the detergents directly into the laundry machine or into a dispensing cup, a timer circuit for controlling the pumping time, and a set of control switches for turning on/off the dispensing mechanism.

In one aspect of the embodiment two or more rectangular containers are placed inside the add-on box to store detergents. A hard or soft cylindrical tube with sufficient diameter is installed to the bottom of each of the containers for supplying or supplement detergent with one end staying outside of the add-on box for easy access. A soft tubing is linked from the bottom of the detergent container to a rotary pump and passes through the rotary pump to a dispensing opening.

In one aspect of the embodiment, a timer circuit is connected with an electric liquid pump that pumps detergent from the containers to a designated receiving place, either to the laundry machine or to a user's cup.

In one aspect of the embodiment, a timer circuit is connected with the power switch board so that when the operation of the laundry machine is first switched on, the detergent dispenser is automatically turned on and pumps a predefined amount of detergent into the laundry washer.

In one aspect the timer circuit is adjustable with various timer settings which in turn determines the amount of detergent to be dispensed.

In one aspect the time circuit, the set of control switches and the liquid pumps are pre-assembled in a rectangular box.

Thus this application discloses a simple and easy detergent dispenser all-in-one add-on box that can easily installed on different types of commercial washers.

BRIEF DESCRIPTION OF THE DRAWINGS

The disclosed application will be described with reference to the accompanying drawings, which show important sample embodiments of the invention and which are incorporated in the specification hereof by reference, wherein.

DETAILED DESCRIPTION OF SAMPLE EMBODIMENTS

The numerous innovative teachings of the present application will be described with particular reference to presently preferred embodiments (by way of example, and not of limitation). The present application describes several embodiments, and none of the statements below should be taken as limiting the claims generally.

For simplicity and clarity of illustration, the following figures illustrate the general manner of construction, and description and details of well-known features and techniques that may be omitted to avoid unnecessarily obscuring the invention. Additionally, elements in the figures are not necessarily drawn to scale; some areas or elements may be expanded to help improve understanding of the embodiments of the invention.

The terms "first," "second," "third," "fourth," and the like in the description and the claims, if any, may be used for distinguishing between similar elements and not necessarily for describing a particular sequential or chronological order. It is to be understood that the terms used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

The term "timer circuit" refers to an integrated circuit (IC) controller chip together with a set of transistors, diodes and capacitors that switches on a power voltage for the motor of a pump for a preset period of time. For example industry programmable AT80052 microcontroller is programmed to set the time by using set input switches. Actual use of a timer controller will be according to the manufacture's instruction.

Figure 1:
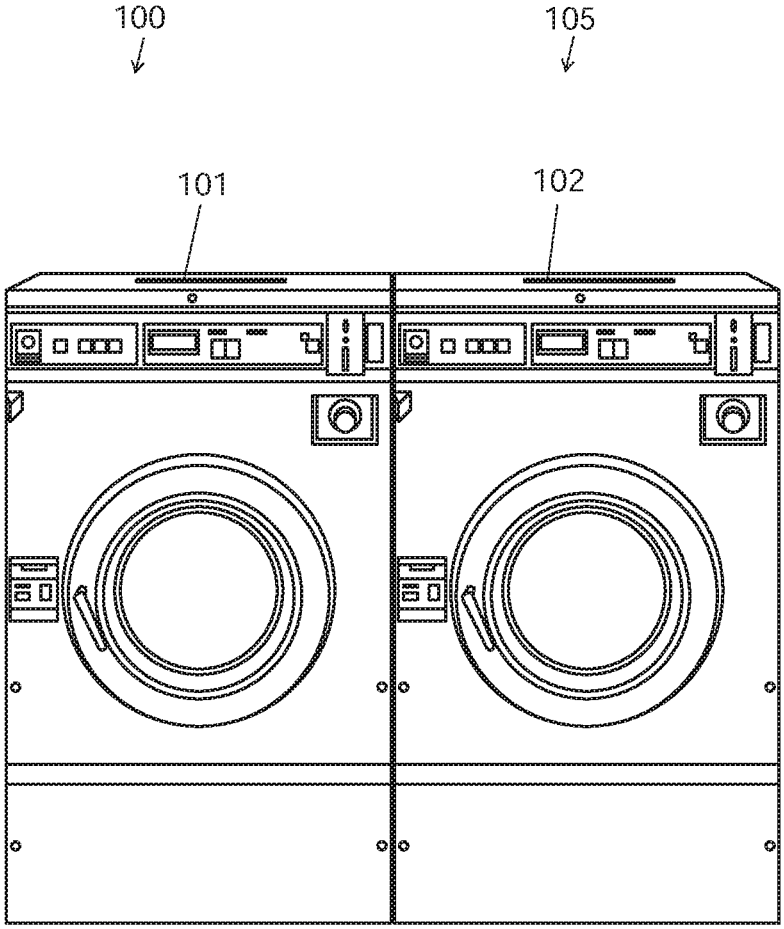
FIG. 1 shows a set of laundry washer in a laundry store.

In reference to FIG. 1, a setup of a pair of conventional commercial laundry washers 100 and 105 is shown. In a laundromat, most of the laundry washers are arranged side by side similar to washer 100 and washer 105. There is generally no space between the machines, the spaces in the front of the machines and in the back of the machines are also very limited. It is very difficult to install a detergent dispensing arrangement as described in US 2006/0117811 or to make costly replacement with machines as described in U.S. Pat. No. 8,555,677. The only available installation space for improvement is the space above the machines. For coin-operated commercial laundry washers, if they have a side door for input clothing, they generally have an opening such as 101 and 102 shown in FIG. 1 at the top of the machine for manually supplementing detergents.

Figure 2:
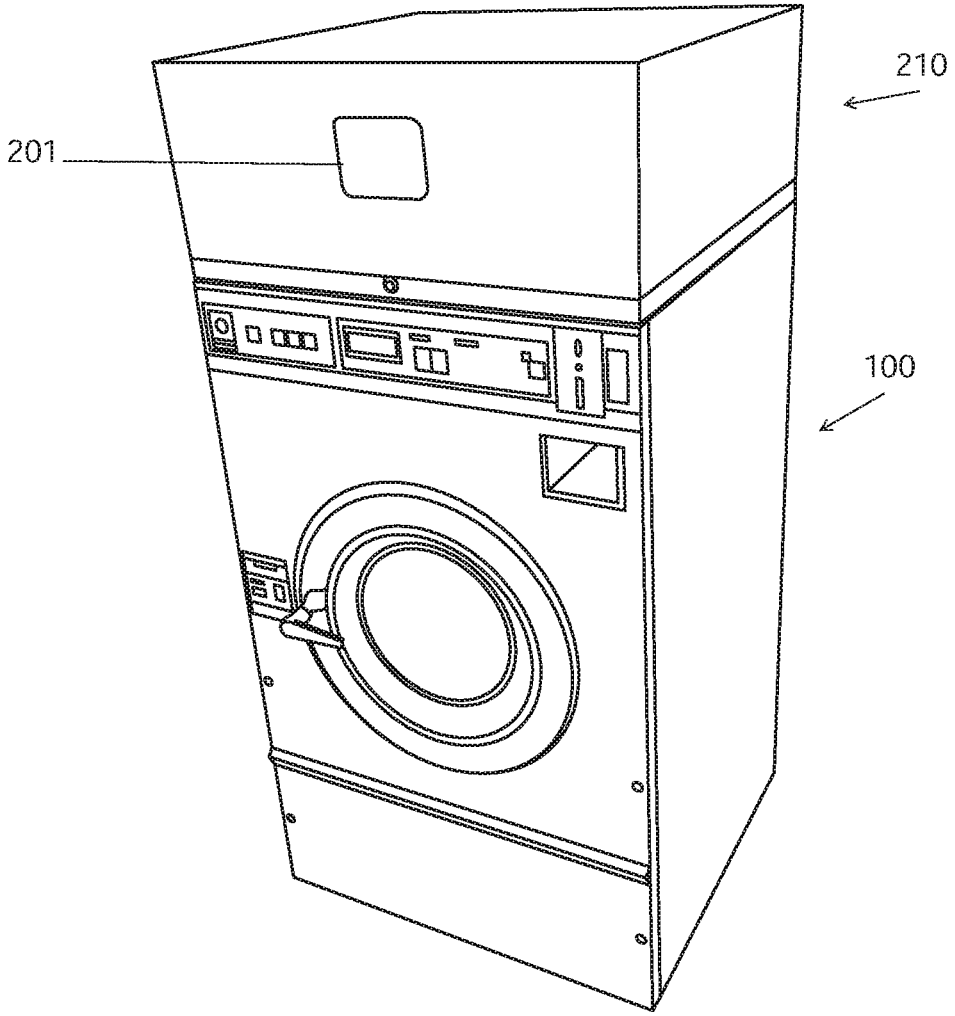
FIG. 2 shows a laundry washer machine mounted with an example all-in-one add-on box for aliquoting detergents.

In reference to FIG. 2, laundry washer 100 is shown to have installed with an all-in-one add-on detergent dispensing box 210. Add-on detergent box 210 has a matching dimension to the top of laundry washer 100, preferably a rectangular metal or plastic box made of durable material, and it may include a detergent dispensing window 201 where a user can obtain detergents and add to laundry washer 100 manually or for other additional cleaning.

Figure 3:
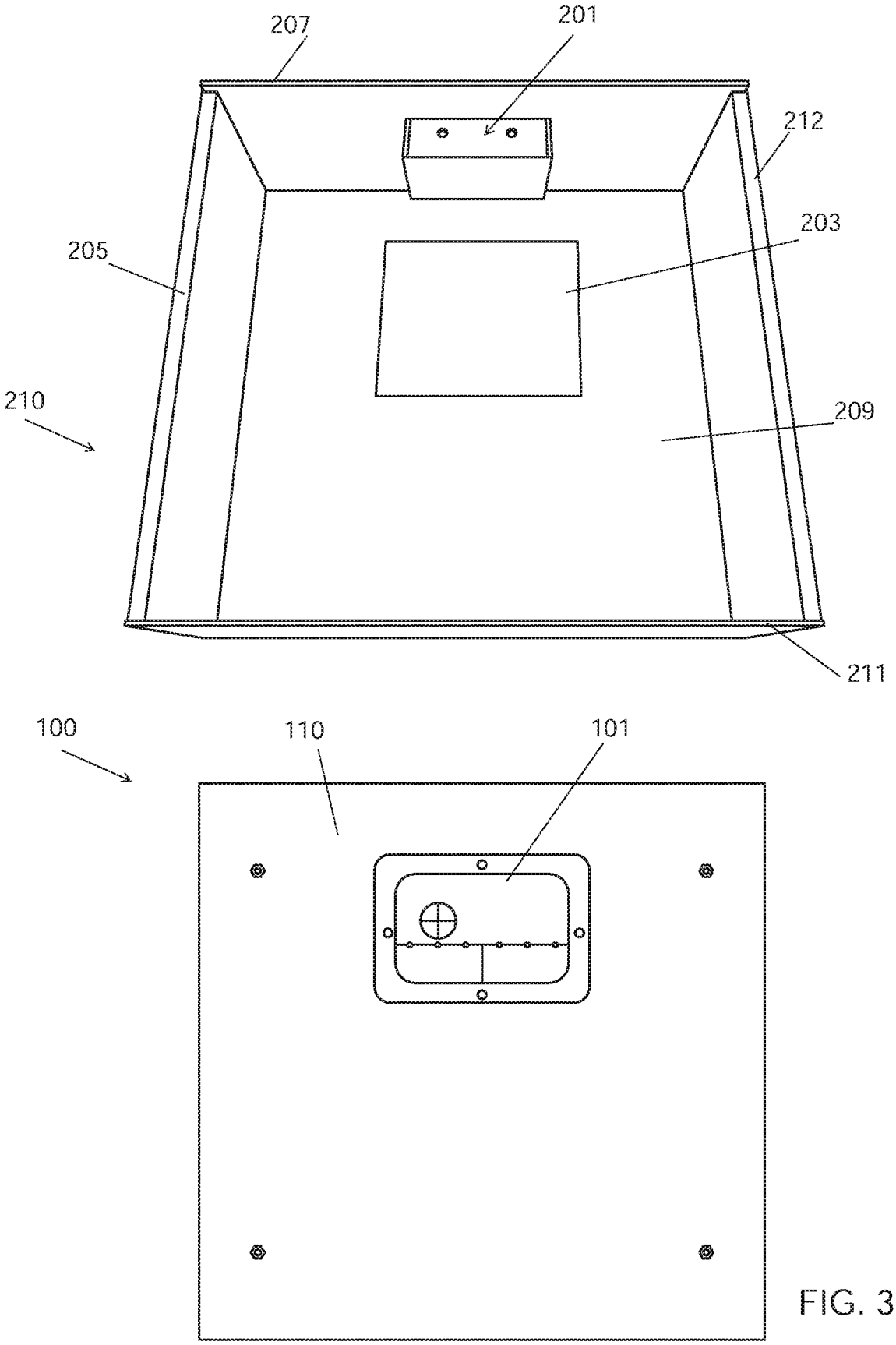
FIG. 3 shows an example interaction mechanism between the counter top of a washer machine and an example add-on box for automatic detergent dispensing in accordance with this application.

In reference to FIG. 3, the interaction surfaces between washer machine 100 and add-on detergent dispensing box 210 are shown. The bottom structure of add-on box 210 is preferably a rectangular structure constructed with metal or plastic material, having a front wall 207, side walls 205 and 212, rear wall 211 and bottom wall 209. The size of bottom wall 209 preferably is in the same shape and size as that of the top 110 of laundry washer 100. In the bottom wall 209, an aperture 203 is constructed in order for add-on box 210 to interact with washer 100. Aperture 203 is preferably in similar shape and size as to that of opening 101 on the top of washer 100. Additionally, other shapes or sizes of the add-on box, as well as the bottom wall shape and sizes are also contemplated. A person skilled in the art may adjust the shape and size according to the need of installation, the limitation of space, manufacturing cost and/or other considerations. In the front wall 207, a built-in dispensing window box 201 is constructed in order for a user to interact with the operation of the add-on detergent dispensing box 210.

Figure 4:
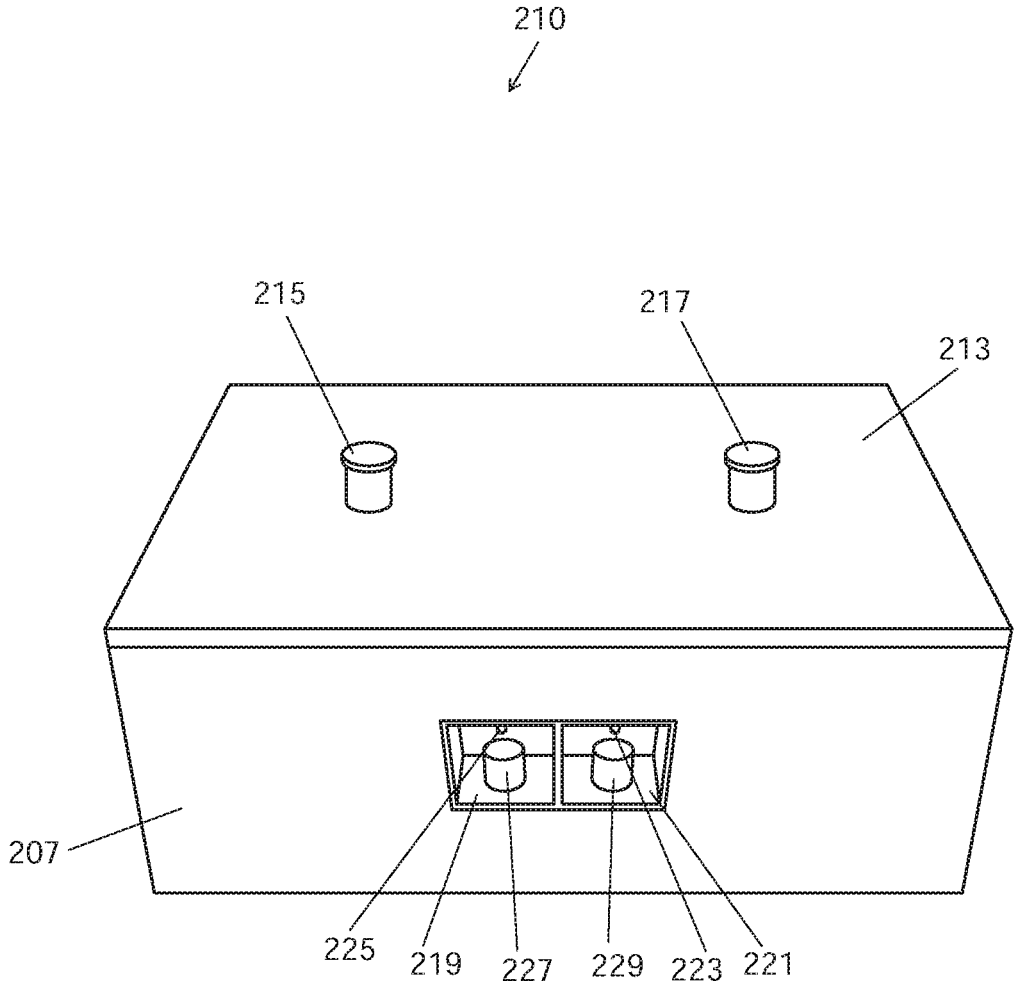
FIG. 4 shows a prospective view of an example exterior of an example add-on box for a laundry machine in accordance with this application.

In reference to FIG. 4, an example exterior structure of add-on box 210 is shown. Add-on box 210 also includes a top cover lid 213, which contains at least two apertures for allowing two cylindrical hard or soft pipes 215 and 217 to be installed into inside add-on box 210. The two cylindrical pipes 215 and 217 may be configured to be of the same size or may be of different sizes, preferably they be of sightly different sizes to distinguish them from each other, and preferably at 0.8-2 inches in diameter, one feet to two feet in length. Pipes 215 and 217 serve as an easy detergent re-fill entry tubes, the entry openings may be covered with caps. The size and length of pipes 215 and 217 can vary depends on the size of the detergent storage containers. The number of pipes can also vary depends on the number of the detergent storage containers. A person skilled in the art may adjust the shape and size according to the need of installation, the limitation of space, manufacturing cost and/or other considerations. The exterior of front wall 207 includes carved-in window sections 219 and 221 with a support platform for cups 227 and 229 or small containers for receiving detergent dispensed from the detergent storage containers inside the add-on box. Dispensing mouths 225 and 223 are mounted in the carved-in window respectively, dispensing mouths 225 and 223 are connected with respective individual dispensing tubes connected from a separate detergent container.

Figure 5:
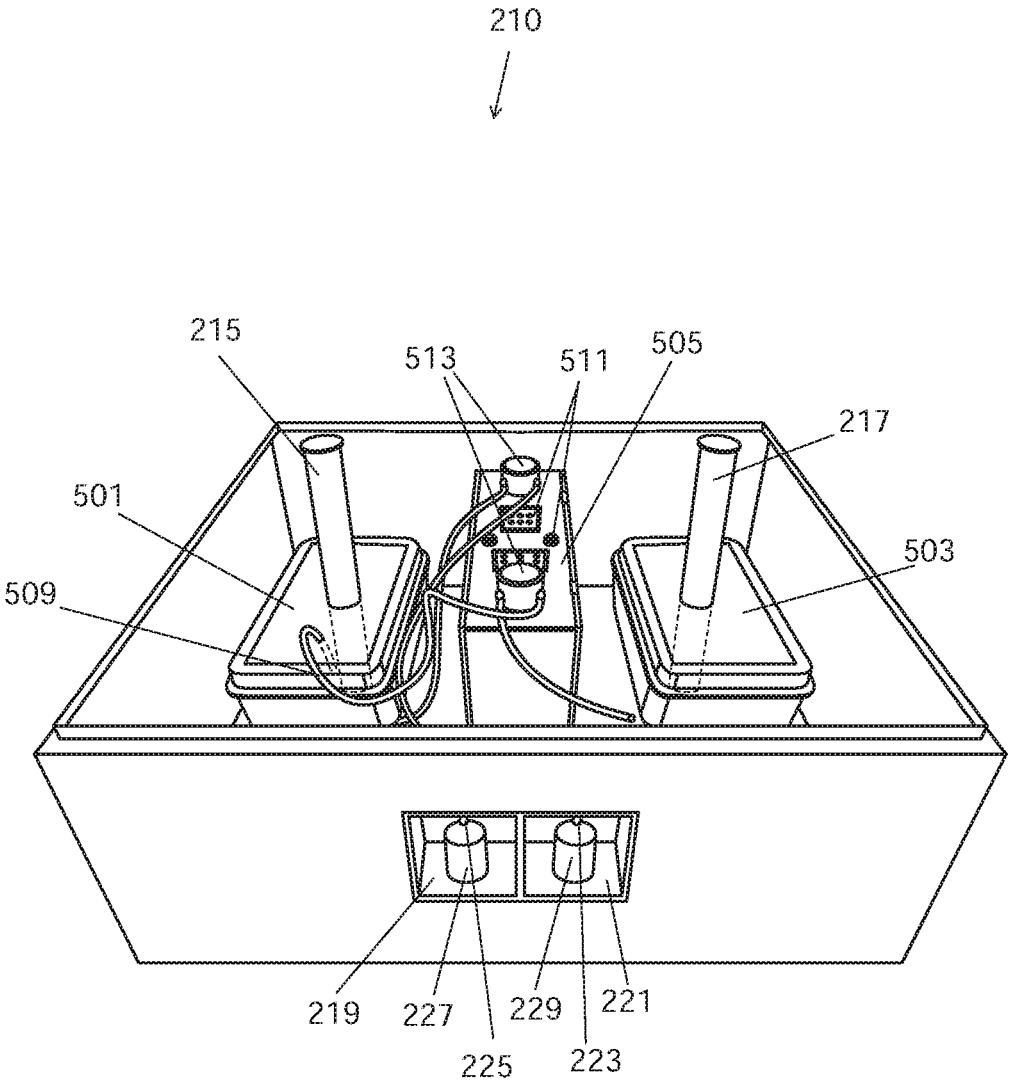
FIG. 5 shows a prospective view of an example internal structure of an example add-on box for a laundry machine.

In reference to FIG. 5, an example internal structure of add-on box 210 is shown that includes a plurality number of detergent storage containers 501 and 503, an electric pump assembly box 505 for installing detergent pumps and timer circuits, a corresponding number of detergent refill tubes 215 and 217 and a plurality of tubing 509 connecting between the storage containers, detergent pumps and detergent output ports 225 and 223. Detergent storage containers 501 and 503 are preferably made in rectangular shape, and are separate and independent, removably installed inside add-on box 210, in a size as large as add-on box 210 allows, and may be marked with different colors. Electric pump assembly box 505 is installed a number of pumps 513 and timer circuits 511. Electric pump assembly box 505 is preferably a separate and independent box for easy repair and adjustment. The number of pumps and the number of timer circuits may vary and depend on the number of detergent containers inside the add-on box. Each individual pump may preferably be responsible for pumping a detergent from one container, and each timer circuit may be set up to control one individual pump. The pumps may be alternatively set up to pump detergents from multiple containers, and a time circuit may be alternatively set up to control multiple pumps. Electric pump assembly box 505 and detergent storage containers 501 and 503 may be made in other shapes, preferably in complementary shapes in order to save space in side the add-on box. Theirs location in side the add-on box may be fixed or may be changeable. Bumpers may be set to the bottom wall 209 of add-on box 210 to prevent them from moving.

Figure 6:
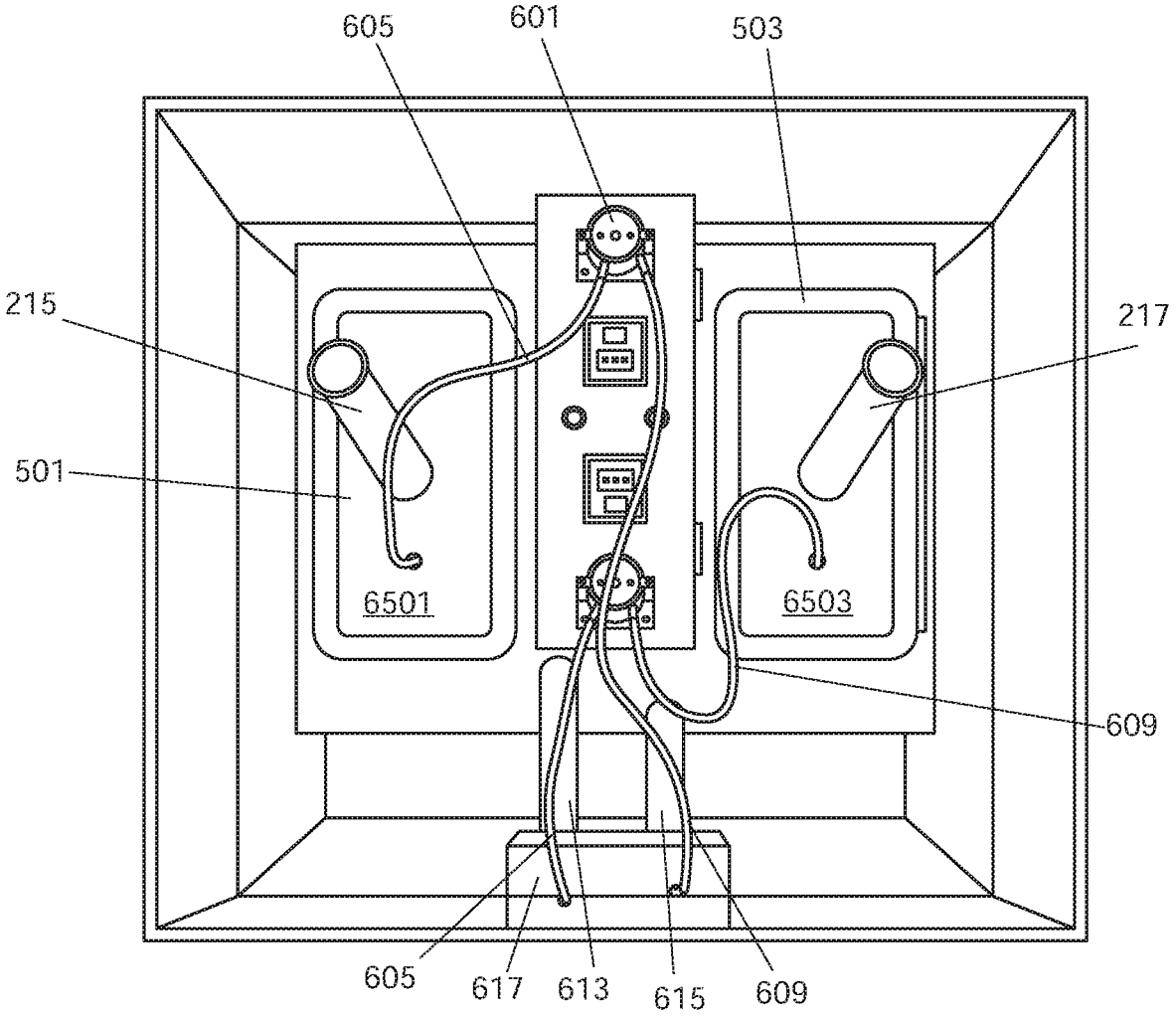
FIG. 6 shows a top view of an example internal structure of an example add-on box for a laundry machine.

In reference to FIG. 6, a top view of the configuration of tubing inside the add-on box 210 is shown. Detergent storage containers 501 and 503 are respectively configured with a removable cover 6501 and 6503 where detergent refill tubes 215 and 217 are inserted into preferably in a vertical position relative to the container covers 6501 and 6503. Refilling detergent will be poured in through the refill tubes to the storage containers. Storage containers 501 and 503 may hold about or more than 5 gallons of detergent, and can be made of any suitable material, such as plastic material or metal. Storage container 501 may store one type of laundry detergent, and storage container 503 may store a softener or another type of detergent. One opening of detergent dispense tube 605 may be fixedly mounted at the bottom of storage container 501, and the tube may go through cover 6501, or alternatively go directly from the bottom of storage container, through the rotary motor of pump 601 and extend to dispensing window box 617 while the other opening is fixed with a dispensing tip 225 as shown in FIG. 4. Similarly, one opening of detergent dispense tube 609 may be fixedly mounted at the bottom of storage container 503, and the tube may go through cover 6503, or alternatively go directly from the bottom of storage container, through the rotary motor of pump 603 and extends to dispensing window box 617 with the other opening fixed with a dispensing tip 223 as shown in FIG. 4. Dispensing window box 617 is preferably constructed as a rectangular box having a top panel and bottom panel. The top panel supports the dispense tubes and bottom panel withholds two conduit tubes 613 and 615 that are connected to top opening 101 of the washer machine shown in FIG. 3.

Figure 7:
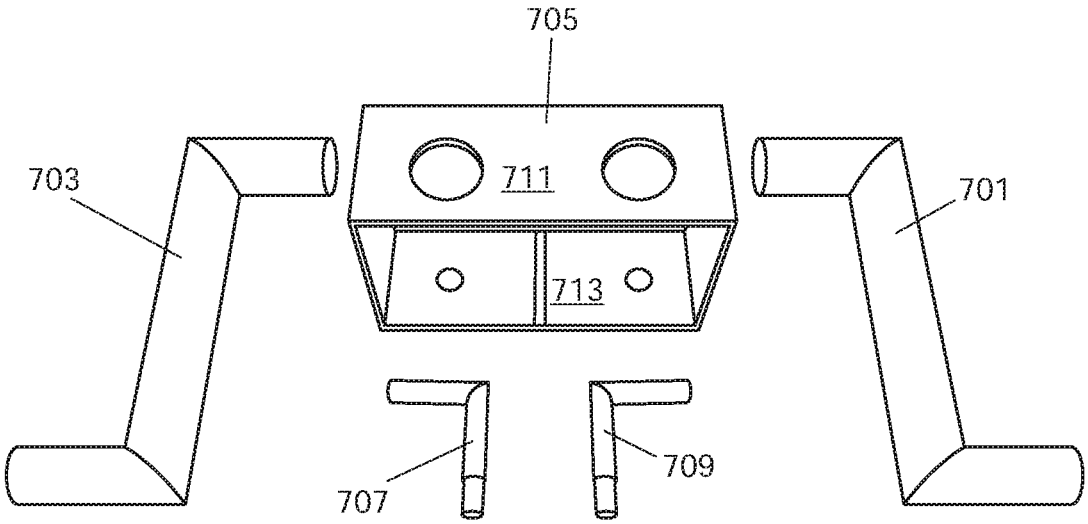
FIG. 7 shows an example set of the disassembled mechanic parts of the dispensing structure of an example add-on box for a laundry machine.
Figure 8:
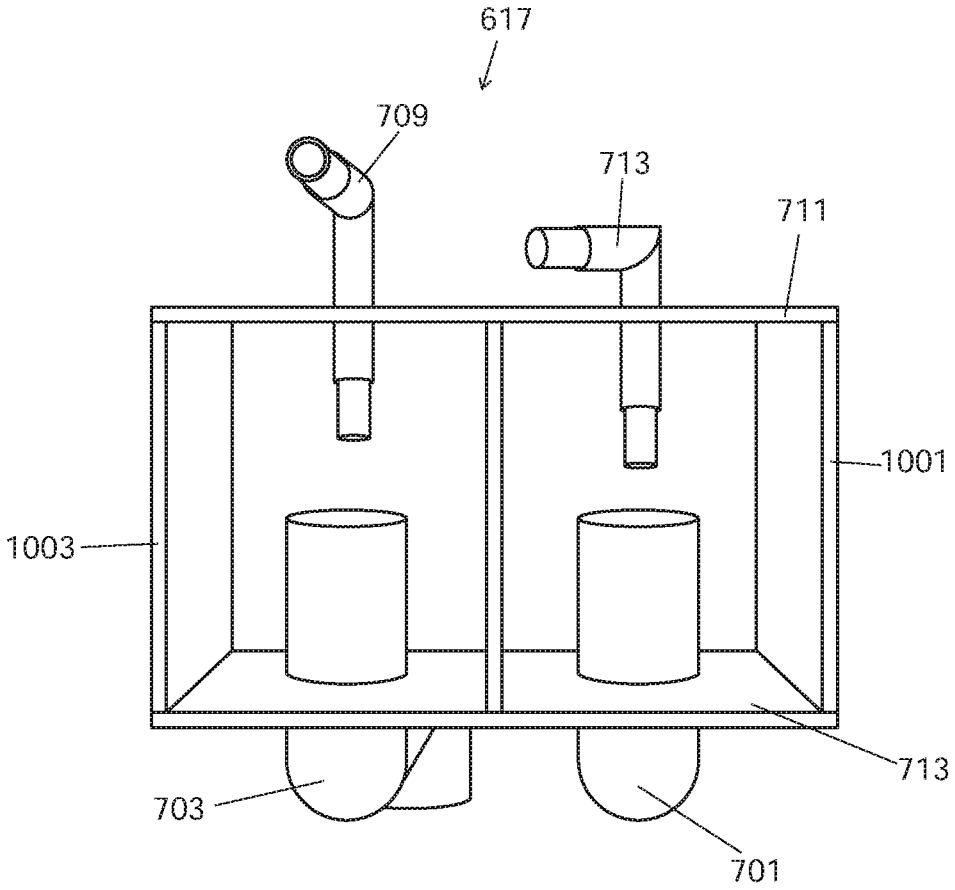
FIG. 8 shows a front view of an example assembled dispensing structure of an example add-on box for a laundry machine.
Figure 9:
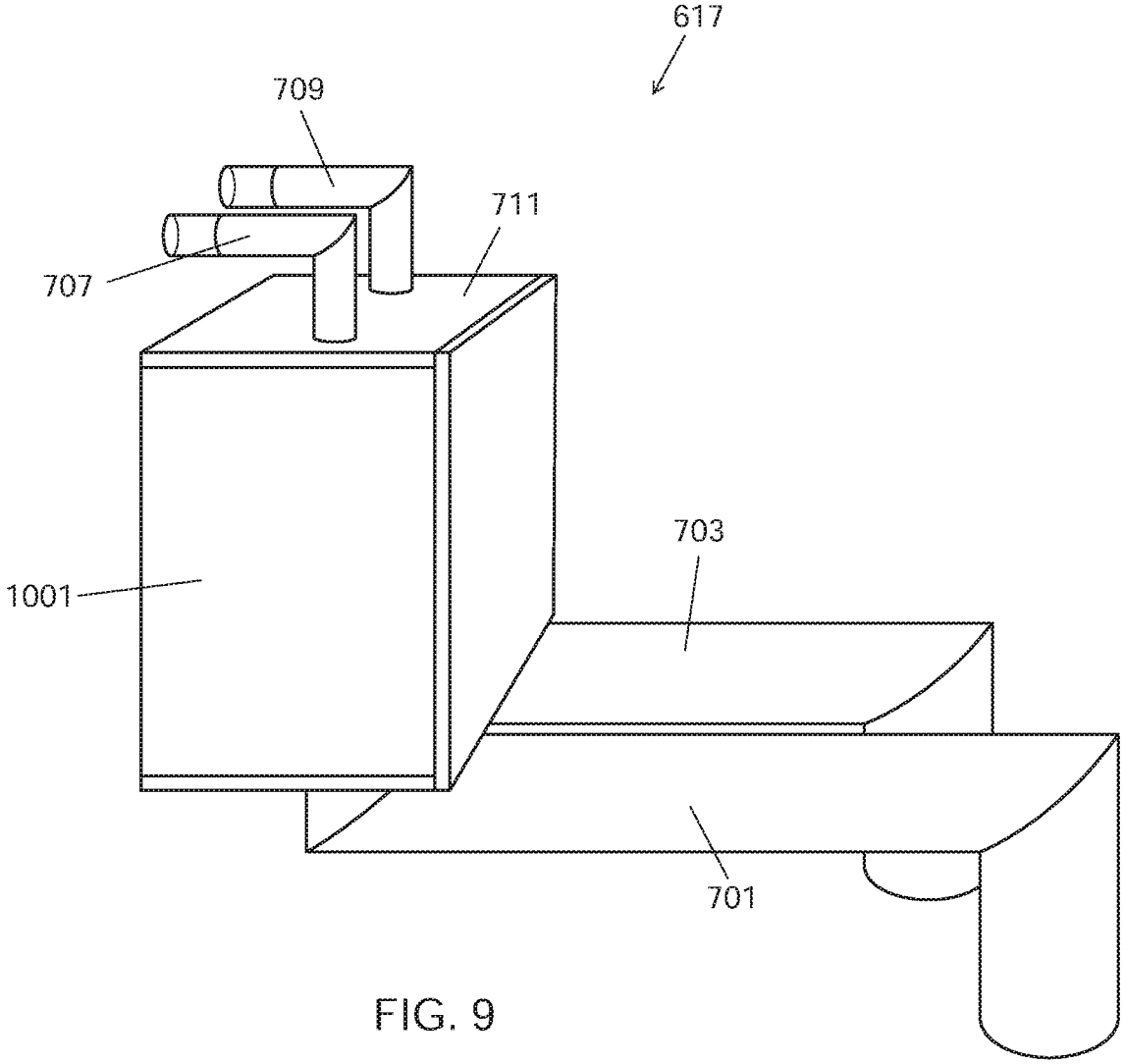
FIG. 9 shows a side view of an example dispensing structure of an example add-on box for a laundry machine.
Figure 10:
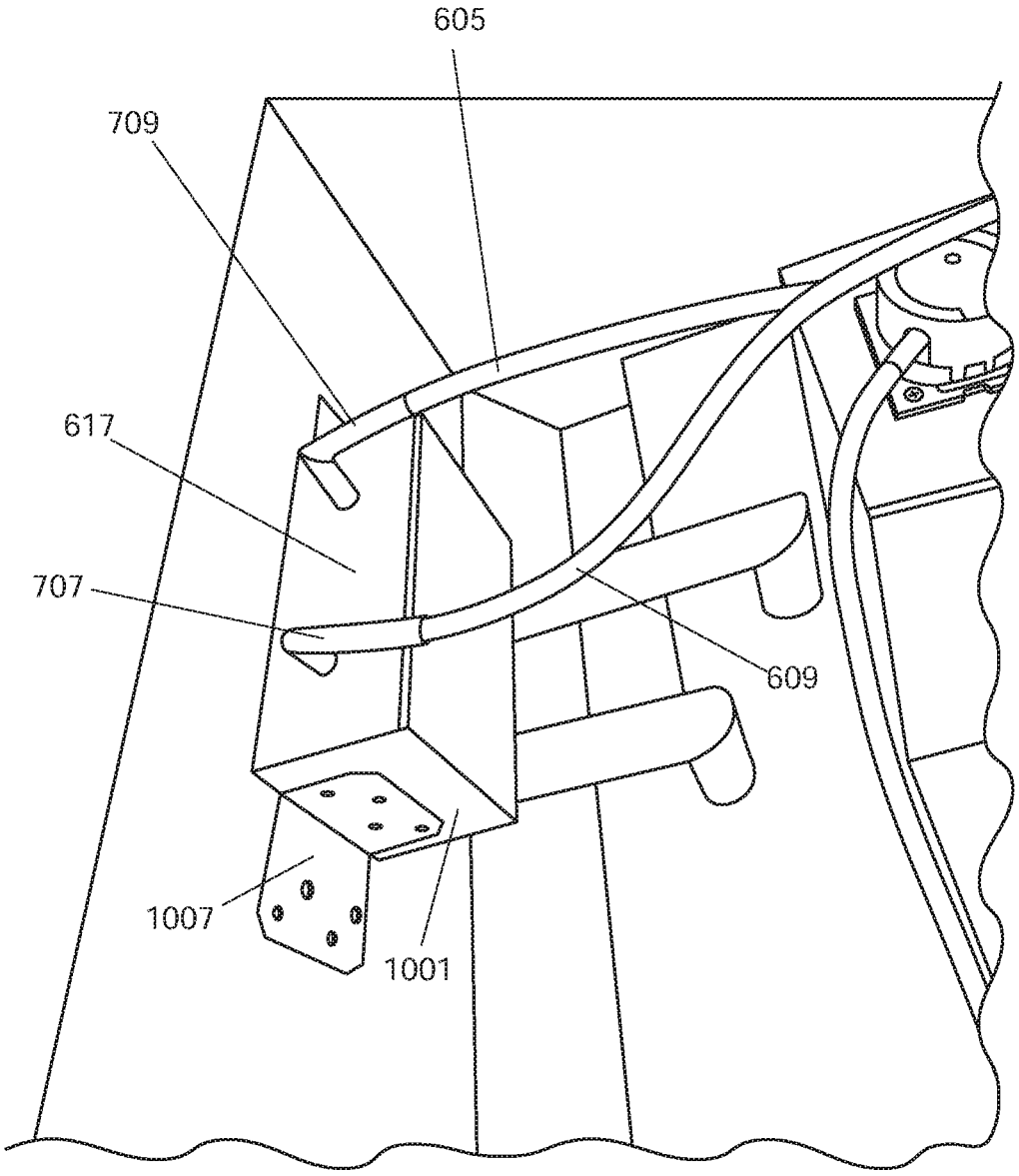
FIG. 10 shows a prospective view of an example dispensing structure in interaction with a dispensing pump of an example add-on box for a laundry machine.

In reference to FIG. 7, FIG. 8, FIG. 9 and FIG. 10, an detailed structure of dispensing window box 617 is shown. FIG. 7 lists the structural components of dispensing window box 617 including two or more conduit tubes 701 and 703 for conducting detergents to the washer machine, dispense tube tips 707 and 709, and a supporting frame 705 for providing two supporting panels 711 and 713, each having apertures for holding the two conduit tubes and two dispense tube tips as shown in FIG. 8 and FIG. 9. As shown in FIG. 8, dispensing window box 617 preferably also includes two side walls 1001 and 1003. The length and width of window box 617 may be configured to be around 2-7 inches, a person in the art will know to adopt different sizes according to the particular size of a washer machine. Dispensing window box 617 may be mounted onto the front window 201 of the add-on box with a hinge 1007 as shown in FIG. 10. Conduit tubes 701 and 703 extend through the opening 203 in FIG. 3 into the opening 101 of the washer machine.

Figure 11:
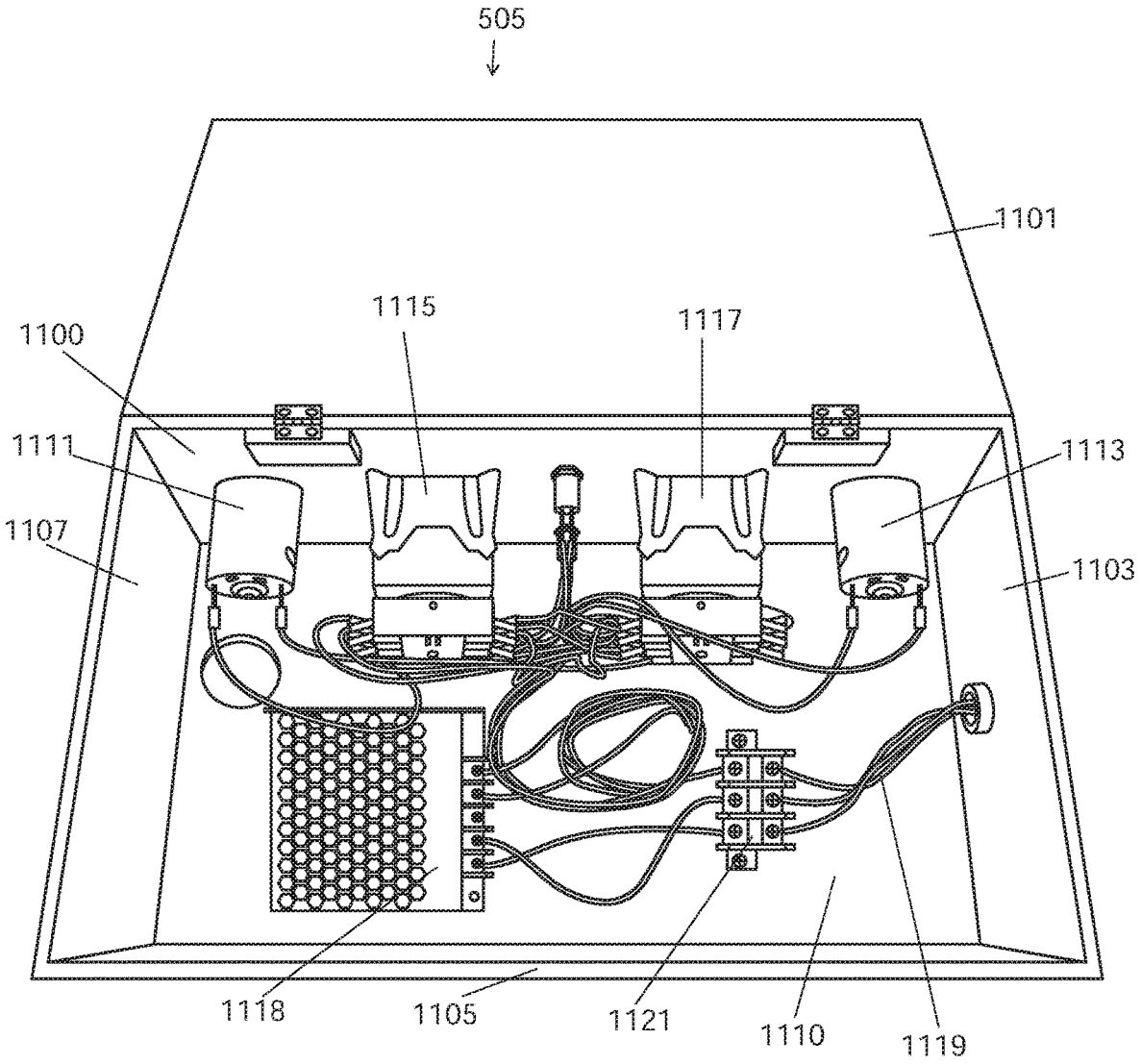
FIG. 11 shows a top view of an example organizing box of a dispensing pump and an electronic controller unit of an example add-on box for a laundry machine.
Figure 12:
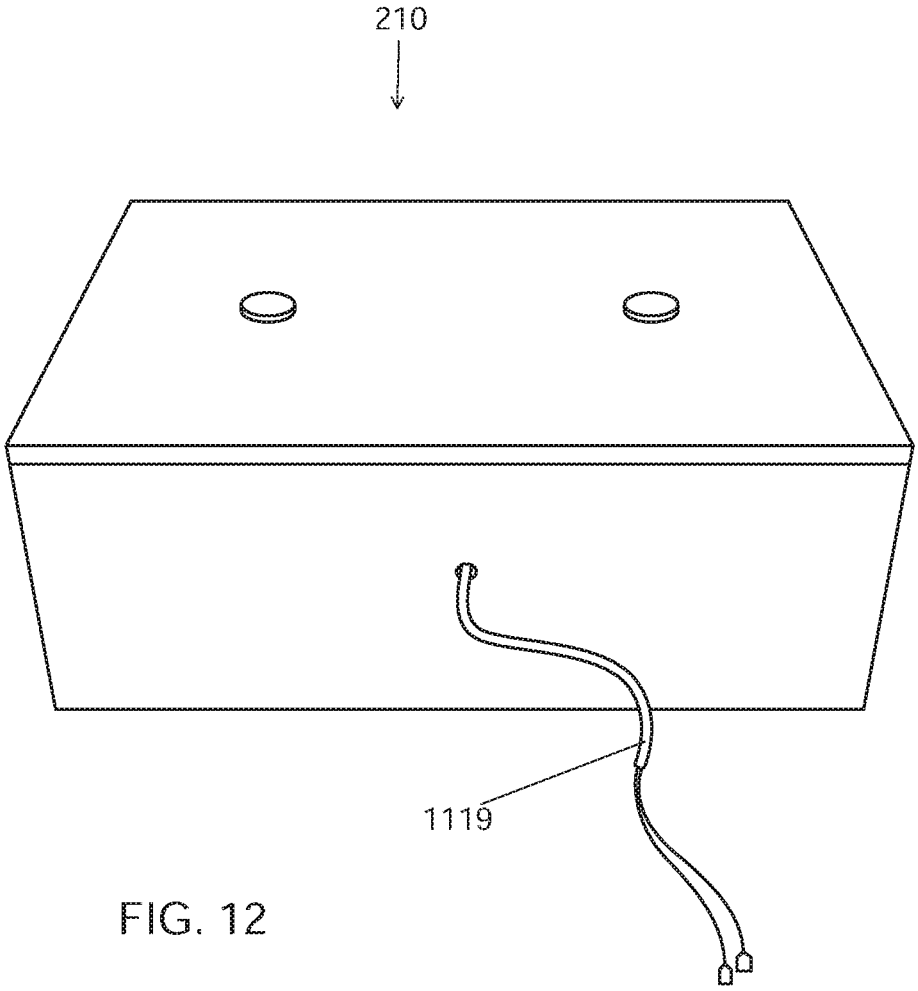
FIG. 12 shows a view of an example electronic cable construction of an example add-on box for connecting to the laundry machine.

In reference to FIG. 11, the structure of electronic controller box 505 is shown. Electronic controller box 505 is also preferably configured as a rectangular box having three side walls 1103, 1105, 1107, two mounting walls 1100 and 1110 and a cover lid 1101. Mounting wall 1110 for supporting the electronic circuits 1118 and wire components 1121. Top side wall 1100 provides a mounting frame for the two or more pumps 1111 and 1113 and the two or more timer user interfaces 1115 and 1117 for receiving user input setting. Timer circuits 1118 receives user input setting from timer interface 1115 or 1117, then sets a time count to switch the power on for pump 1111 or pump 1113. When time runs out, timer circuits 1118 will switch off the power for either pump 1111 or 1115, and the pump will then stop pumping the detergent from the corresponding detergent container to the dispense hose tip. Wire set 1119 cross through wall 1103 (FIG. 12) to connect to an electric power source in order for the whole electronic setup to operate. When in use, box lid 1101 closes the box, allowing the whole electric pump setup be compartmentalized in a portable controller box 505. Timer circuit 1118 is a well known art and is commercially available. For an example of such circuit, FIG. 7 of US Patent Application 2006/0117811 is incorporated by reference. portable controller box 505 as a whole is positioned on bottom wall 209 surrounded with bumpers to prevent from moving.

Figure 13:
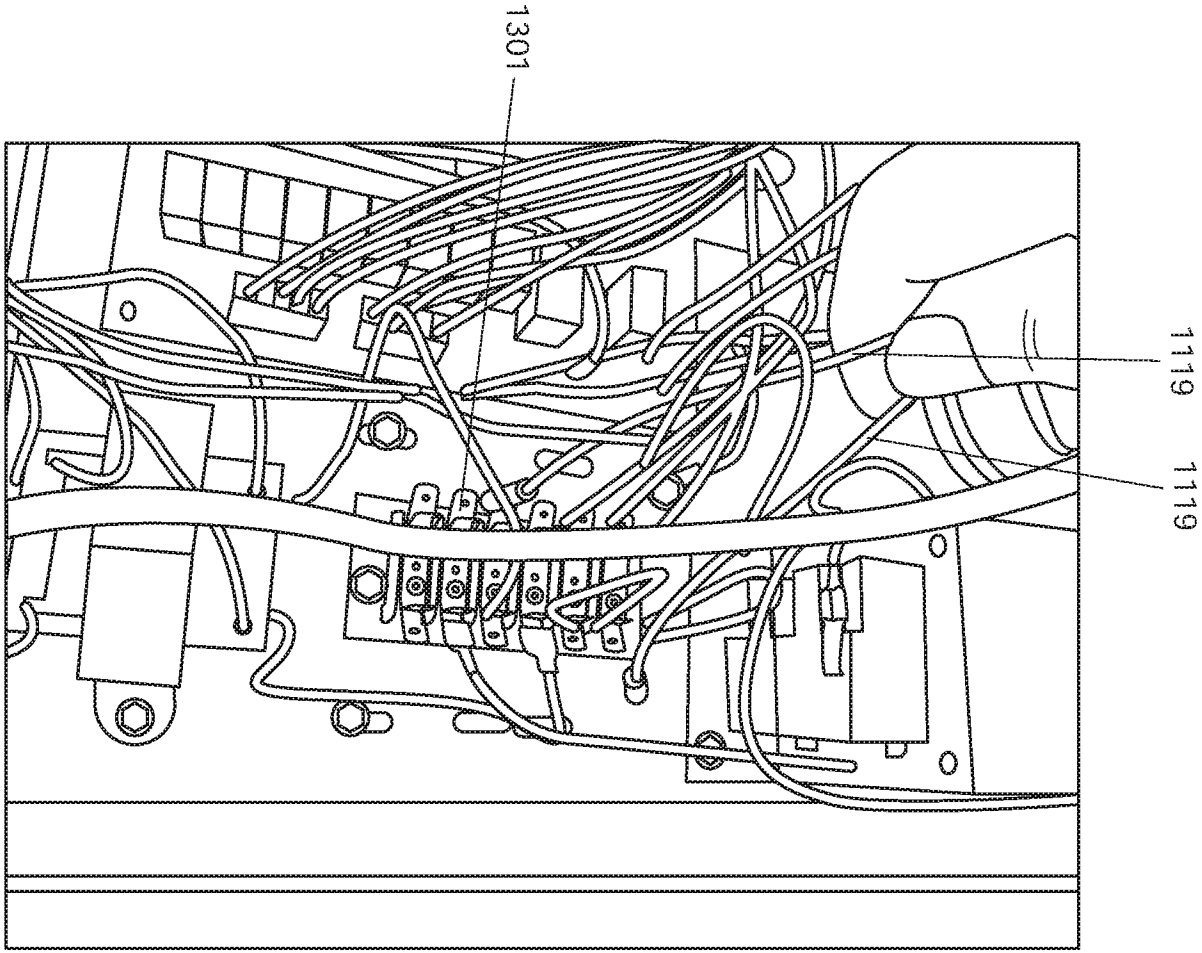
FIG. 13 shows a view of an example way of connecting the electronic cables of an example add-on box to the electric controlling panel of a laundry washer.

In reference to FIG. 13, wire set 1119 are demonstrated to be connected to the power board 1301 of a laundry washer machine which may be controlled by a user pushing the power button of the washer machine, or by a coin-operated mechanism. In operation, the power switch on the washer machine will also provide power to wire set 1119 and thus to the timer circuit 1118. Timer circuit 1118 then switches on pumps 1111 or 1113 which will start to press the dispense tubes 605, drawing up the liquid detergent from storage containers 501 or 503 into the dispense tubes 605 and move along to the dispense exit tips 707 or 709, and in turn to detergent conduit tubes 701 or 703, and into the wash chamber of the washer machine. At the per-determined time, the timer circuit will turn off the power switch which in turn will turn off the pumps, therefore only a predefined amount detergent is dispensed. Alternatively, a user may use a cup or a detergent receptacle to collect the dispensed detergent.

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims. None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle. The claims as filed are intended to be as comprehensive as possible, and NO subject matter is intentionally relinquished, dedicated, or abandoned.

What is claimed is:

1. A laundry washer machine add-on box for dispensing detergent, comprising:

a housing structure mountable to a laundry washer machine, having a left-side panel, a right-side panel, a bottom panel, a front-side panel, a rear-side panel and a top lid, said front-side panel having an aperture for mounting a detergent dispense window box, said bottom panel having an aperture for mounting at least one detergent dispense conduit to a laundry washer machine;

at least one storage container for storing detergent having a bottom, said storage container being removably positioned on said bottom panel inside said housing structure;

at least one electric liquid pump mounted inside said housing structure;

at least one timer circuit that is electronically connected with said electric liquid pump for controlling power supply to said electric liquid pump, mounted inside said housing structure; and a liquid dispensing tubing having a first opening end connecting to the bottom of said storage container, extending through said electric liquid pump, and having a second opening end connected with a dispensing tip or nozzle, said dispensing tip or nozzle being mounted on the detergent dispense window box.

2. The laundry washer machine add-on box of claim 1, wherein said top lid of said housing structure further comprises at least one aperture, and said storage container further comprises an aperture in order for detergent refilling.

3. The laundry washer machine add-on box of claim 2, further comprising at least one tubular pipe having a cap that fits into both the aperture on the top lid of said housing structure and the aperture on said storage container for refilling detergent to said storage container.

4. The laundry washer machine add-on box of claim 1, wherein the laundry washer machine has a power controller board for turning on the laundry washer machine, and said at least one timer circuit is electrically connected to the power controller board of the laundry washer machine, whereby when the laundry washer machine turns on its power, said timer circuit is activated.

5. The laundry washer machine add-on box of claim 1, wherein said timer circuit is adjustable to plurality of timer settings.

6. The laundry washer machine add-on box of claim 1, wherein said detergent dispense window box comprises a top panel, a bottom panel and a rear panel, said top panel of the detergent dispense window box forming at least one aperture for holding said dispensing tip or nozzle, and said bottom panel of the detergent dispense window box forming at least one aperture for holding a detergent dispense conduit as a receptacle for detergent dispensed from said dispensing tip or nozzle.

7. The laundry washer machine add-on box of claim 6, further comprising at least one detergent dispense conduit mounted on said bottom panel of detergent dispense window box.

8. The laundry machine add-on box of claim 1, further comprising an electric pump assembly box having a cover side, a pump-supporting side, and an electronic-circuit mounting panel, wherein said pump-supporting side is mounted with said at least one electric liquid pump and at least one timer-setting user interface that is electronically connected with said at least one time circuit, said electronic-circuit mounting panel is mounted with said at least one timer circuit.

9. The laundry machine add-on box of claim 8, wherein at least one storage container and said electric pump assembly box are immobilized on said bottom panel of said housing structure by plurality of bumpers.

10. A laundry washer machine add-on box for dispensing detergent, comprising:

a housing structure mountable to a laundry washer machine, having a left-side panel, a right-side panel, a bottom panel, a front-side panel, a rear-side panel and a top lid, said front-side panel having an aperture for mounting a detergent dispense window box, said bottom panel having an aperture for mounting at least one detergent dispense conduit to a laundry washer machine;

a plurality of storage containers for storing detergent, said storage containers being removably positioned on said bottom panel inside said housing structure;

an electric pump assembly box having a cover side, a pump-supporting side, and an electronic-circuit mounting panel, wherein said pump-supporting side is mounted with a plurality of electric liquid pumps and at least one timer-setting user interface that is electronically connected with at least one timer circuit, said electronic-circuit mounting panel is mounted with a timer circuit panel that is electronically connected with said plurality of electronic liquid pumps and switches off power supply to at least one of said electric liquid pumps after a pre-defined period of time; and a plurality of liquid dispensing tubings each having a first opening end connecting to the bottom of one of said plurality of storage containers, extending through one of said electric liquid pumps, and having a second opening end connected with a dispensing tip or nozzle, said dispensing tip being fixedly mounted on said detergent dispense window box.

* * * * *